US008550302B1

(12) United States Patent
Laible

(10) Patent No.: US 8,550,302 B1
(45) Date of Patent: Oct. 8, 2013

(54) WALL MOUNTED DISPENSER

(76) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 13/465,471

(22) Filed: May 7, 2012

(51) Int. Cl.
*B67D 7/78* (2010.01)

(52) U.S. Cl.
USPC ..... 222/133; 222/145.1; 222/181.3; 137/892; 137/895; 137/614.2

(58) Field of Classification Search
USPC ..... 222/181.3, 335, 145.5, 518, 133, 222/129.2, 145.1; 137/888, 892, 895, 614.2
See application file for complete search history.

(56) References Cited

U.S. PATENT DOCUMENTS

| | | | | |
|---|---|---|---|---|
| 3,658,216 | A | 4/1972 | Schwartzman | |
| 5,791,525 | A * | 8/1998 | Fan | 222/181.3 |
| 5,915,592 | A * | 6/1999 | Mehus et al. | 222/1 |
| 6,082,593 | A * | 7/2000 | Borcherds | 222/181.3 |
| 6,142,345 | A | 11/2000 | Laible | |
| 6,283,330 | B1 * | 9/2001 | Gillespie et al. | 222/145.7 |
| 6,299,035 | B1 * | 10/2001 | Dalhart | 222/505 |
| 6,439,272 | B1 * | 8/2002 | Wertheim | 141/2 |
| 6,499,872 | B2 * | 12/2002 | Sand | 366/160.1 |
| 6,789,708 | B2 * | 9/2004 | Hansen | 222/505 |
| 6,923,345 | B1 | 8/2005 | Laible | |
| 6,945,432 | B2 | 9/2005 | Laible | |
| 6,945,433 | B2 | 9/2005 | Laible | |
| 6,986,443 | B2 | 1/2006 | Laible | |
| 7,331,488 | B2 * | 2/2008 | Naslund et al. | 222/144 |
| 7,832,599 | B2 | 11/2010 | Laible | |
| 8,459,506 | B2 * | 6/2013 | Schiller et al. | 222/145.5 |
| 2004/0050438 | A1 * | 3/2004 | Haas | 137/888 |
| 2004/0065673 | A1 * | 4/2004 | Hansen | 222/1 |
| 2010/0024896 | A1 * | 2/2010 | Dalhart | 137/87.04 |
| 2011/0095047 | A1 * | 4/2011 | Hubmann et al. | 222/1 |

* cited by examiner

*Primary Examiner* — Kevin P Shaver
*Assistant Examiner* — Michael Melaragno
(74) *Attorney, Agent, or Firm* — Dennis L. Thomte; Thomte Patent Law Office LLC

(57) ABSTRACT

A wall mounted dispenser for dispensing a mixture of water and liquid chemicals which may be used as a separate dispenser or in combination with other like dispensers. The dispenser of this invention includes several backflow preventers to ensure that the water supply will not become contaminated during backflow problems.

6 Claims, 10 Drawing Sheets

WALL MOUNTED DISPENSER

BACKGROUND OF THE INVENTION

1. Field of the Invention

This invention relates to a wall mounted dispenser for dispensing a water and liquid chemical mixture therefrom and more particularly to wall mounted dispensers which may be fluidly connected together in a side-by-side series manner.

2. Description of the Related Art

Many types of dispensers have been previously provided for dispensing liquid chemicals into a receptacle such as a bottle, bucket, etc. Further, many of the prior art dispensers are able to dispense a water and liquid chemical mixture into a receptacle. However, it is Applicant's belief that the prior art dispensers are not able to be connected in a series manner in a side-by-side manner. Further, it is not believed that the prior art dispensers are fully able to prevent back flow from the dispenser to the source of water which is especially dangerous when the dispenser is used to dispense a water and liquid chemical mixture therefrom.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A wall mounted dispenser is disclosed for dispensing a mixture of water and liquid chemical therefrom. The dispenser of this invention may be used in conjunction with other dispensers so that the dispensers are positioned side-by-side in a series manner. Inasmuch as the dispenser can be used as a separate dispenser or used in conjunction with other dispensers, only a single dispenser will be described in this summary.

The dispenser includes a first horizontally disposed body portion having a first end, a second end, a forward side and a rearward side. A second horizontally disposed body portion extends transversely forwardly from the first body portion. A third vertically disposed body portion extends downwardly from the second body portion. A first elongated water passageway, having inlet and discharge ends, extends through the first body portion. The inlet end of the first water passageway is in fluid communication with a source of water under pressure. The discharge end of the first water passageway is selectively closable. The first body portion has a second water passageway formed therein which extends horizontally forwardly from the first water passageway. The first body portion has a forwardly presented first annular valve seat formed therein at the forward end of the second water passageway.

The second body portion has a bore formed therein which extends forwardly from the first valve seat. The second body portion also has a water passageway which extends downwardly from the bore thereof. The bore of the second body portion has a greater diameter than the first valve seat.

A cylindrical valve guide is positioned in the bore of the second body portion forwardly of the first valve seat with the rearward end of the valve guide being spaced from the first valve seat. The valve guide has a first bore which extends rearwardly into the valve guide from the forward end thereof. The valve guide has a second bore formed therein which extends rearwardly from the rearward end of the first bore thereof. The second bore of the valve guide has a greater diameter than the first bore of the valve guide. The rearward end of the valve guide has a second annular, rearwardly presented valve seat formed therein. The valve guide has a water passageway having upper and lower ends which extends downwardly from the second bore of the valve guide which fluidly communicates with the water passageway which extends downwardly from the second body portion.

A cap, having a central opening formed therein, is mounted on the forward end of the valve guide. An elongated, horizontally disposed, first valve stem extends rearwardly through the central opening of the cap and into the first bore of the valve guide so that the forward end of the first valve stem is positioned forwardly of the cap and so that the rearward end of the first valve stem is positioned in the rearward end of the bore of the second body portion. The first valve stem is selectively movable between a first outer position to a second inner position. An actuator lever is movably secured to the dispenser for moving the first valve stem between outer and inner positions. The first valve stem has an annular valve mounted thereon which seats upon the second valve seat to close the second valve seat when the first valve stem is in its first outer position. The first valve stem has an elongated bore formed therein which extends forwardly thereinto from the rearward end thereof. An elongated second valve stem is provided with the forward end of the second valve stem being slidably mounted, between extended and retracted positions, in the elongated bore of the first valve stem. A spring is positioned in the elongated bore in the first valve stem forwardly of the forward end of the second valve stem which yieldably urges the second valve stem towards its extended position. The rearward end of the second valve stem has a valve thereon which seats upon the first valve seat to close the first valve seat when the first valve stem is in its first outer position and the second valve stem is in its extended position.

The third body portion has a chamber formed therein which has upper and lower ends. The upper end of the chamber is in fluid communication with the water passageway which extends downwardly from the bore of the second body portion. A poppet means is vertically mounted in the chamber between upper and lower positions. The poppet means includes a hollow cylindrical body member having open upper and lower ends. A hollow stem extends upwardly from the open upper end of the hollow cylindrical body member with the hollow stem having an open side wall and a closed upper end. A spring is positioned in the chamber below the cylindrical body member which yieldably urges the poppet means to its upper position. The closed upper end of the hollow stem of the poppet means closes the water passageway which extends downwardly from the bore of the second body portion when the poppet means is in its upper position.

A discharge conduit having open upper and lower ends is provided with the open upper end of the discharge conduit being in fluid communication with the chamber in the third body portion. The open lower end of the cylindrical body member of the poppet means is in fluid communication with the open upper end of the discharge opening when the poppet means is in its lower position. The discharge end of the liquid chemical conduit is in fluid communication with the discharge conduit below the upper end of the discharge conduit. The inlet of the liquid chemical conduit is in communication with a source of liquid chemical.

The third body portion has a plurality of backflow prevention openings formed therein above the lower end thereof which communicates with the atmosphere. The backflow prevention openings are closed by the cylindrical body member when the poppet means is in its lower position.

The dispenser of this invention not only provides a convenient way of dispensing a chemical and water mixture but also has several backflow preventers which ensure that the water supply will not be contaminated during backflow occurrences.

It is therefore a principal object of the invention to provide an improved dispenser for dispensing a mixture of water and liquid chemicals.

A further object of the invention is to provide a dispenser of the type includes several backflow preventers which ensure that the water source will not become contaminated should backflow problems occur.

A further object of the invention is to provide a dispenser of the type described which may be used separately, or in series combinations with one or more other dispensers.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
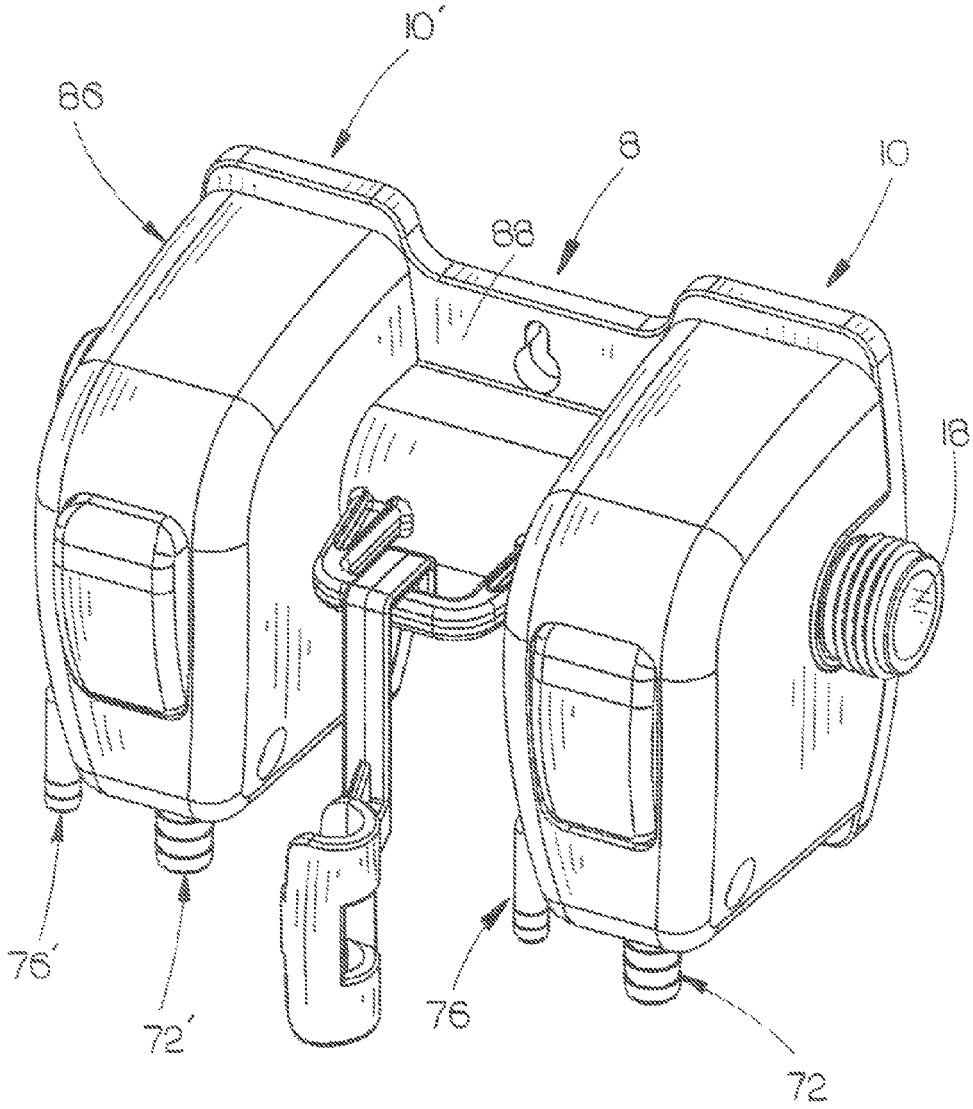
FIG. 1 is a front prospective view of wall mounted dispenser of this invention.
Figure 2:
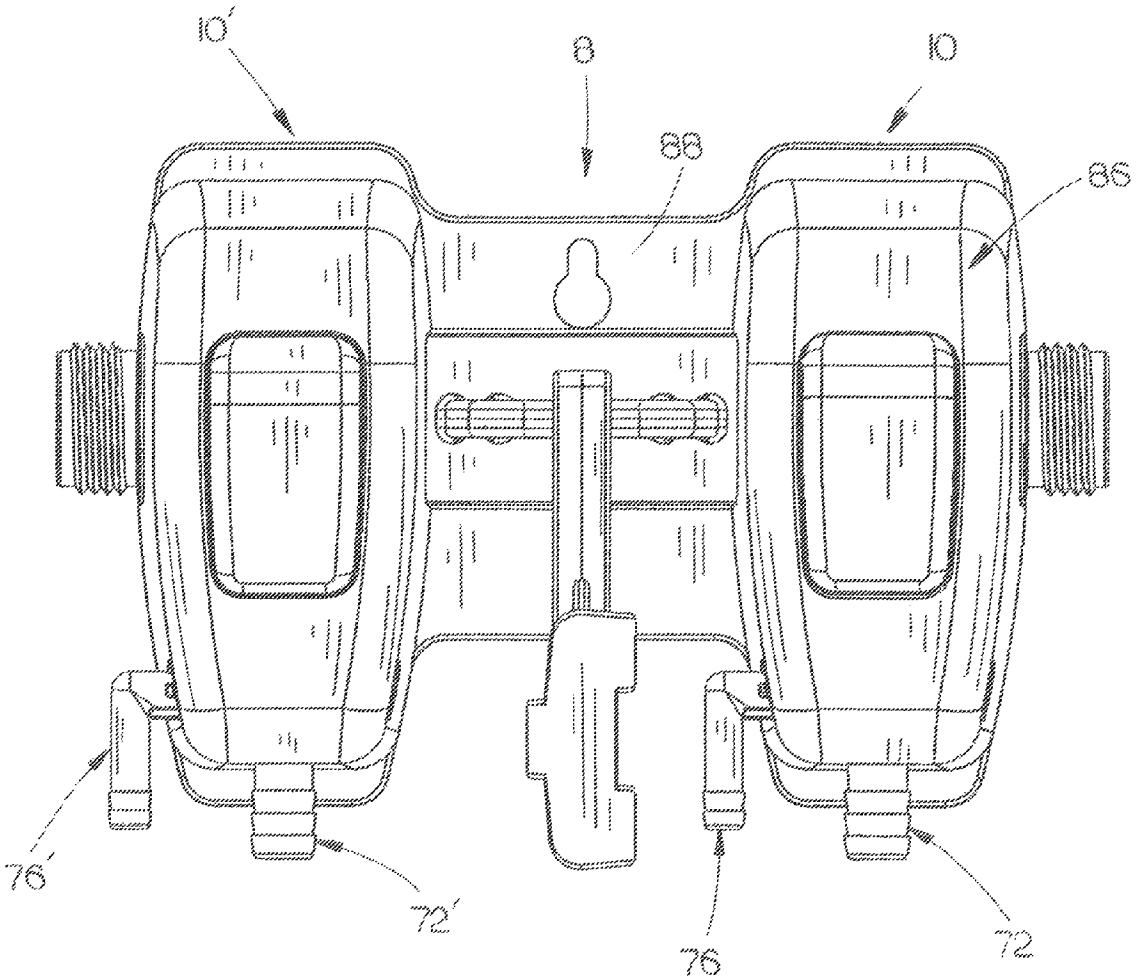
FIG. 2 is a front view of the wall mounted dispenser of this invention.
Figure 3:
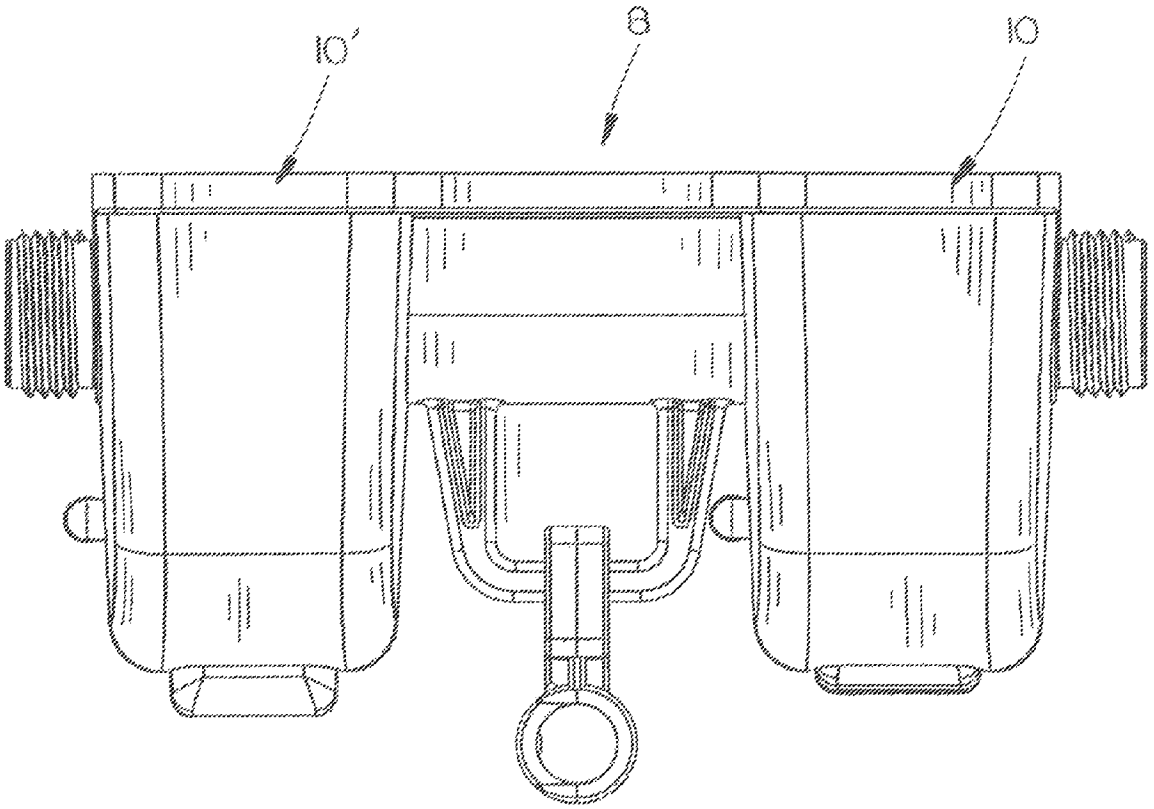
FIG. 3 is a top view of the wall mounted dispenser of this invention.
Figure 4:
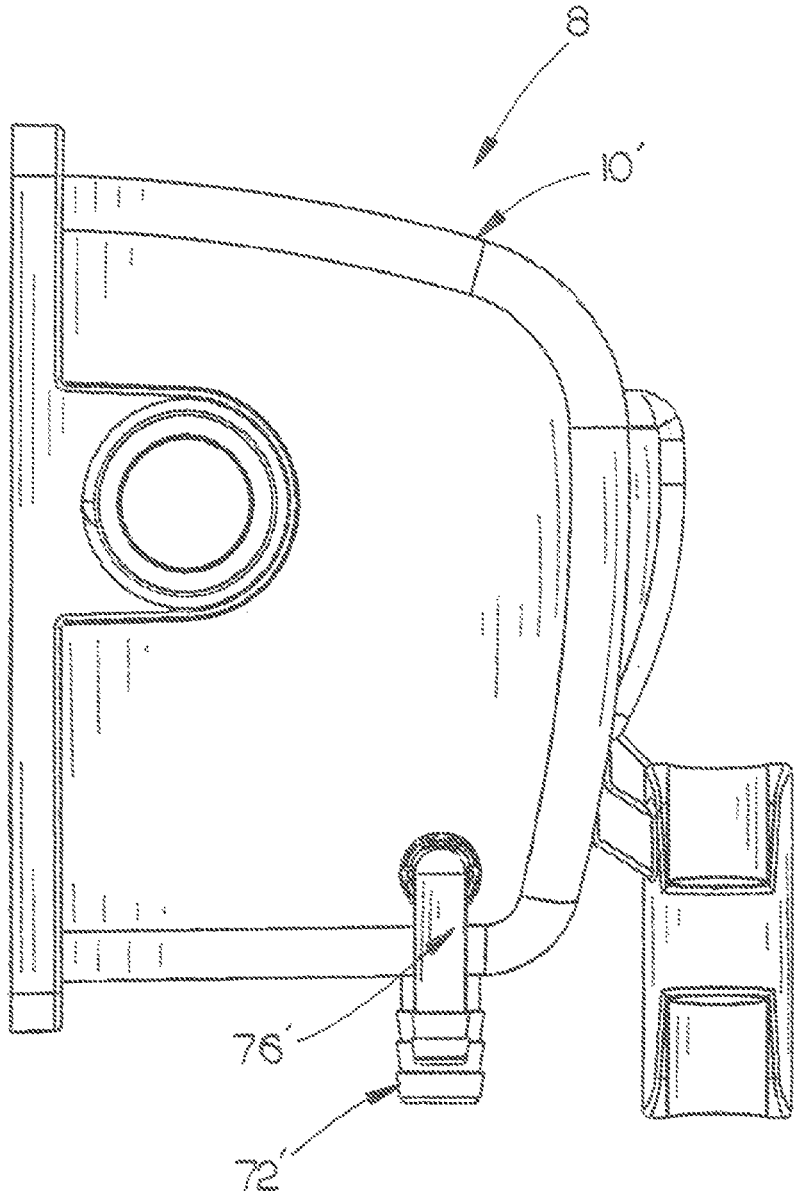
FIG. 4 is a left-end view of the wall mounted dispenser of this invention.
Figure 5:
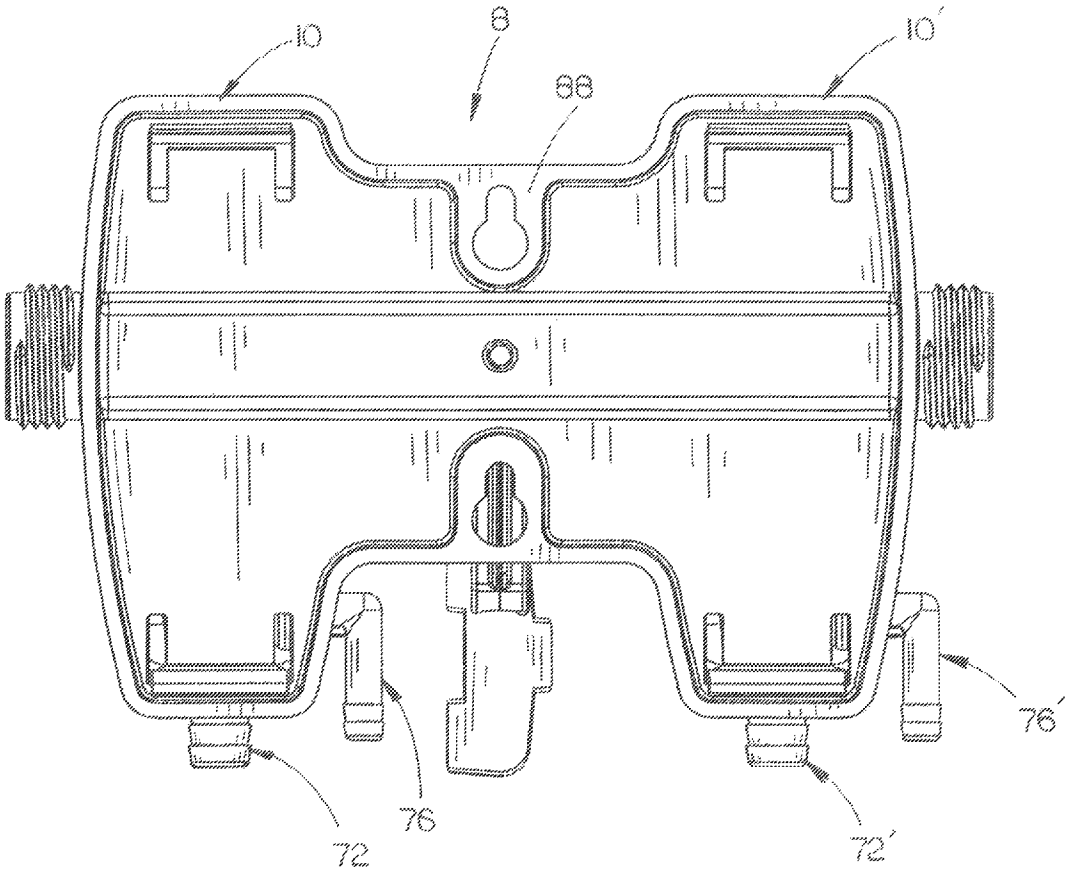
FIG. 5 is a back view of the wall mounted dispenser of this invention.
Figure 6:
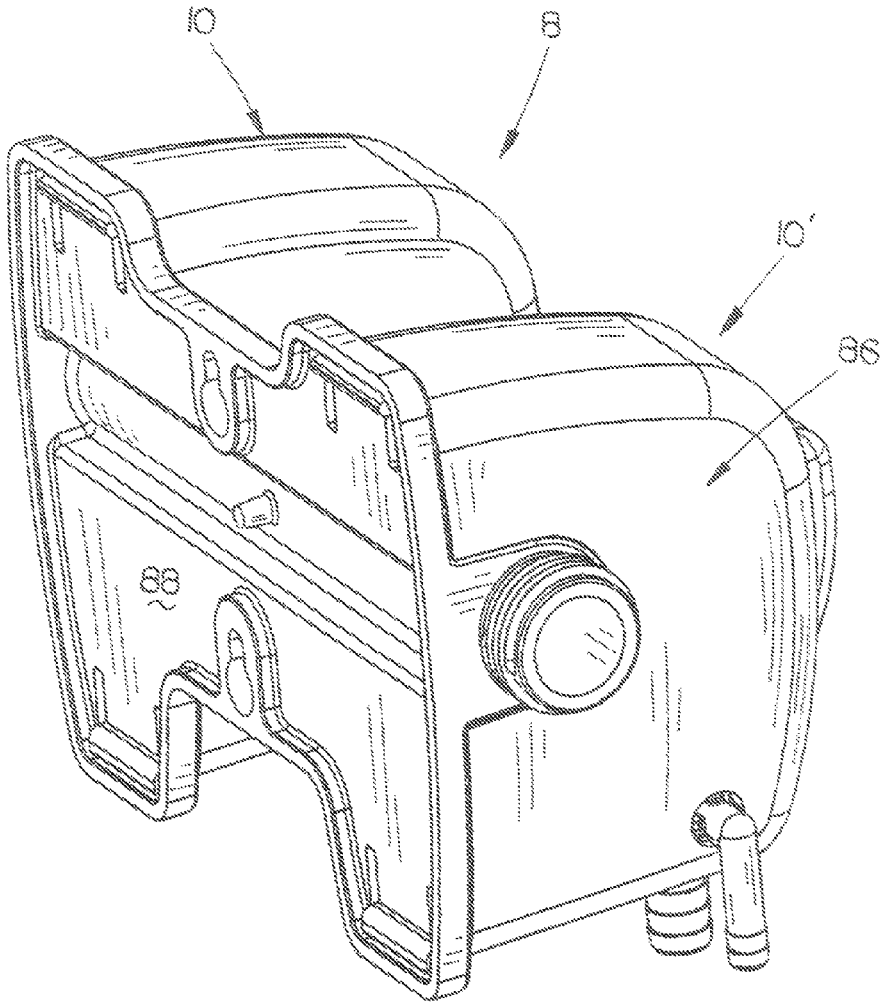
FIG. 6 is a rear prospective view of the wall mounted dispenser of this invention.
Figure 7:
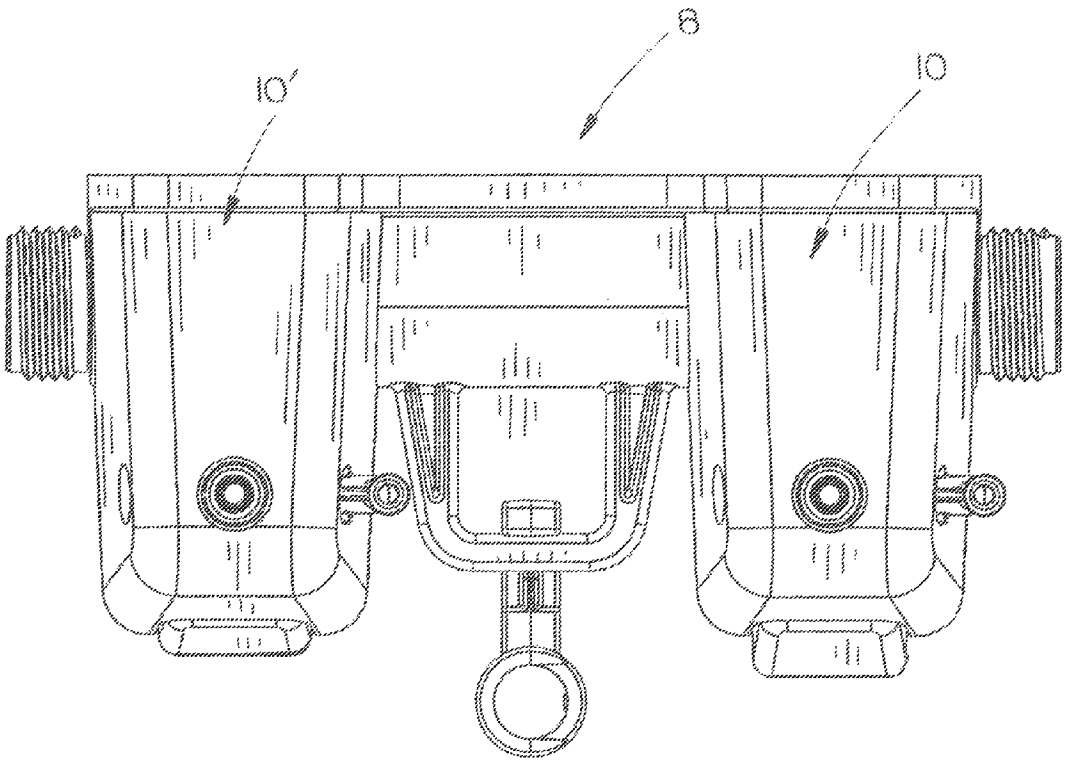
FIG. 7 is a bottom view of the wall mounted dispenser of this invention.
Figure 8:
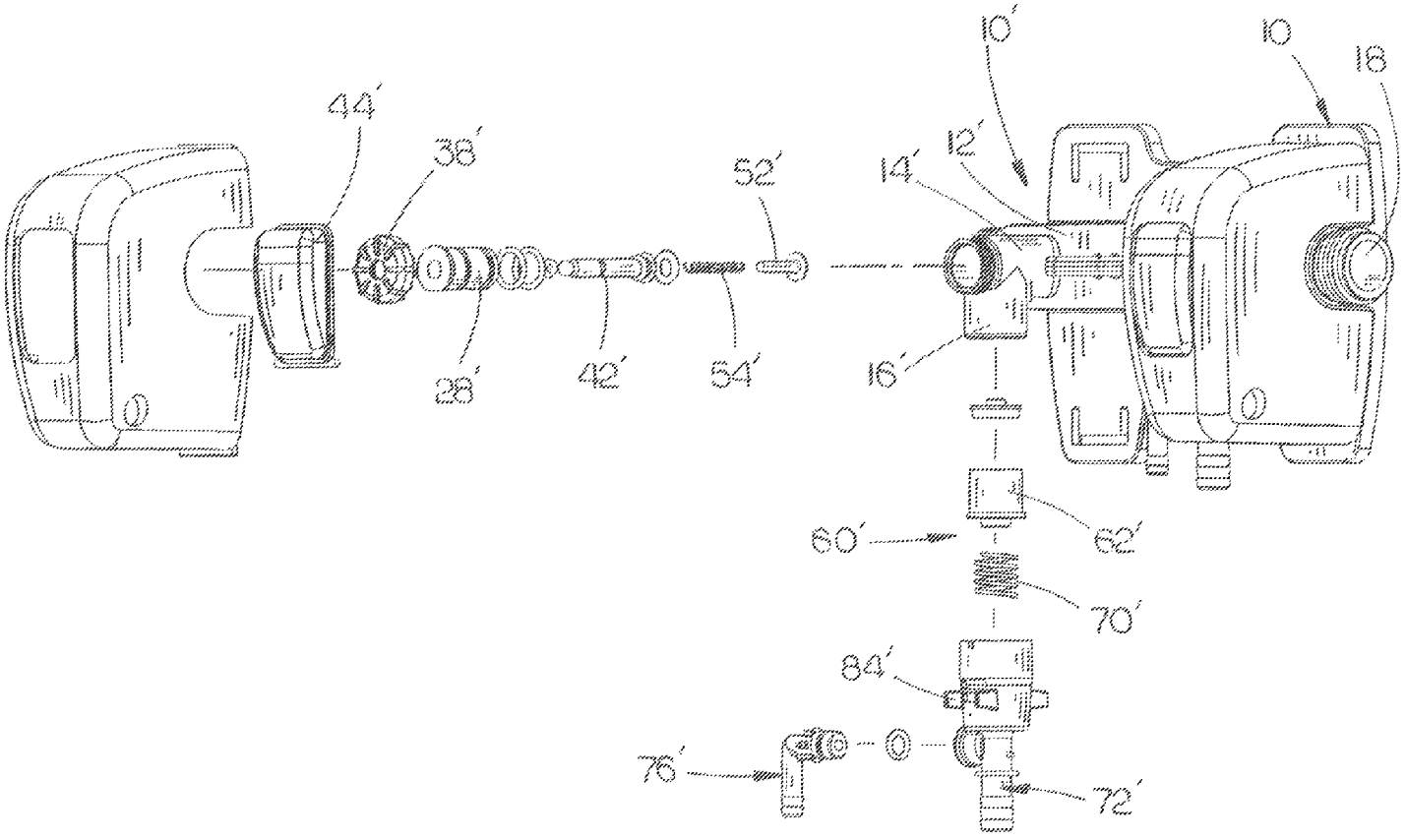
FIG. 8 is a partial exploded perspective view of the wall mounted dispenser of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The wall mounted dispenser assembly of this invention is referred to by the reference numeral 8. The dispenser assembly 8 shown in the drawings includes two dispensers 10 and 10' which are molded together. A single dispenser 10 may be utilized as well as the dual dispenser system which is shown in the drawings. If a separate dispenser 10 is used, any number of those separate dispensers 10 may be coupled together in a side-by-side manner with the inlet end of the first water passageway in the upstream dispenser being connected to a source of water under pressure with the discharge end of the first passageway of the upstream dispenser being fluidly connected to the inlet end of the first water passageway in the downstream dispenser. If only a single dispenser 10 is being used, the discharge end of the dispenser 10 will be closed. In this description, only a single dispenser 10 will be described in detail with a "'" indicating identical structure on dispenser 10'. The dual dispenser assembly 8 will be described.

The dispenser 10 includes a horizontally disposed first body portion 12, a horizontally extending second body portion 14 which extends transversely forwardly from the first body portion 12 and a vertically disposed body portion 16 which extends downwardly from body portion 14.

A first water passageway 18 extends horizontally through body portion 12 and has an inlet end connected to a source of water under pressure. If only a single dispenser 10 is being used, the discharge end of passageway 18 will be closed by a cap or the like. If two dispensers 10 are being used, the discharge end or side of the passageway 18 of the upstream dispenser will be fluidly connected to the inlet end of the first passageway of the downstream dispenser 10.

The first body portion 12 has a second water passageway 20 formed therein which extends horizontally forwardly from the first water passageway 18 between the inlet and discharge ends thereof. For purposes of description, the second water passageway 20 will be described as having rearward and forward ends. The first body portion 12 has a forwardly presented annular valve seat 22 formed therein at the forward end of the second water passageway 20.

Figure 9:
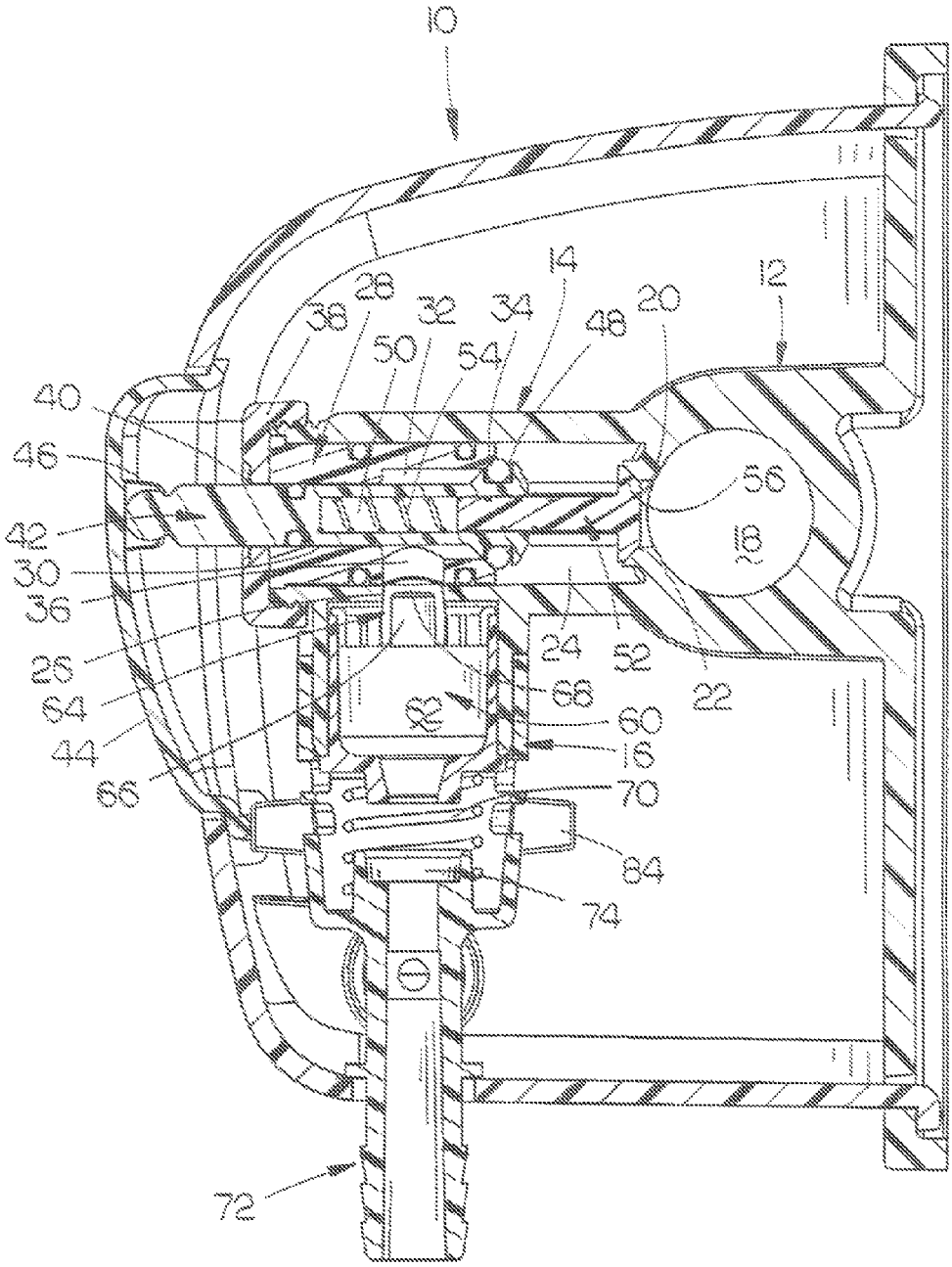
FIG. 9 is a sectional view of the wall mounted dispenser of this invention.

The second body portion 14 has rearward and forward ends and has a bore 24 therein which extends forwardly from the valve seat 22. The second body portion 14 has a water passageway 26 which extends downwardly from bore 24 as seen in FIG. 9. As seen in FIG. 9, the bore 24 in the second body portion 14 has a greater diameter than the diameter of the valve seat 22.

A cylindrical valve guide 28, having forward and rearward ends, is positioned in the bore 24 of the body portion 14 forwardly of the valve seat 22 with the rearward end of the valve guide 28 being spaced forwardly from the valve seat 22. The valve guide 28 has a first bore 30, having forward and rearward ends, formed therein which extends rearwardly into the valve guide 28 from the forward end thereof. The valve guide 28 has a second bore 32 formed therein which has forward and rearward ends formed therein and which extend rearwardly from the rearward end of the first bore 30 of the valve guide 28. The second bore 32 of the valve guide 28 has a greater diameter than the first bore 30 of the valve guide 28. The rearward end of the valve guide 28 has a rearwardly presented valve seat 34 formed therein. The valve guide 28 has a water passageway 36 which extends downwardly from the second bore 32 of the valve guide 28 which fluidly connects with the water passageway 36 in body portion 14. A cap 38, having a central opening 40 formed therein, is mounted on the forward end of the valve guide 28.

The numeral 42 refers to an elongated, horizontally disposed first valve stem which has forward and rearward ends. The first valve stem 42 extends rearwardly through the central opening 40 of the cap 38 into the first bore 30 of the valve guide 28 so that the forward end of the first valve stem 42 is positioned forwardly of cap 38 and so that the rearward end of the first valve stem 42 is positioned in the rearward end of bore 24 of body portion 14. A first valve stem 42 is selectively movable between a first outer position to a second inner position. The numeral 44 refers to an actuator or operating lever which is pivotally mounted with respect to the valve stem 42 and which has a socket 46 formed at the inner side thereof which engages the head of the first valve stem 42 for moving the valve stem 42 between its outer and inner positions.

The first valve stem 42 has an annular valve 48 mounted thereon which seats upon the valve seat 34 when the valve stem 42 is in its outer position.

The first valve stem 42 has an elongated bore 50 formed therein which extends forwardly thereinto from the rearward end thereof. The numeral 52 refers to an elongated second valve stem which has forward and rearward ends. The forward end of the second valve stem 52 is slidably mounted, between extended and retracted positions, in the elongated bore 50 in the first valve stem 42. A spring 54 is positioned in the elongated bore 50 in the first valve stem 42 forwardly of the forward end of the second valve stem 52 which yieldably urges the second valve stem 52 towards its extended position. The rearward end of the second valve stem 52 has a valve 56 thereon which seats upon the first valve seat 22 to close the first valve seat 22 when the first valve stem 42 is in its outer position and the second valve stem 52 is in its extended position.

The third body portion 16 has a chamber 58 formed therein which has upper and lower ends. The upper end of the chamber 58 is in fluid communication with the outer passageway 26 in body portion 14.

The numeral 60 refers to a poppet means which is vertically movably mounted in the chamber 58 between upper and lower positions. The poppet means 60 includes a hollow cylindrical body member 62 having open upper and lower ends. A hollow stem 64 extends upwardly from the open upper end of the hollow cylindrical body member and which is in fluid communication with the interior of the body member 62. The hollow stem 64 has an open side wall 66 and a closed upper end 68. A spring 70 is positioned in the chamber 58 so the body member 62 which yieldably urges the poppet means 66 towards its upper position. The closed upper end 68 of the hollow stem 64 closes the water passageway 26 when the poppet means 60 is in its upper position.

The numeral 72 refers to vertically disposed discharge conduit or tube which has open upper and lower ends. The open upper end of the discharge conduit 72 is in fluid communication with the chamber 58 as seen in the drawings. The lower upper end of the cylindrical body member 62 is in fluid communication with the open upper end 74 of conduit 72 when the poppet means 60 is in its lower position.

The numeral 76 refers to a liquid chemical conduit or tube having an intake end 78 and a discharge end 80. A venturi 82 is created at the juncture of discharge end 80 of conduit 76 and the conduit 72.

The third body portion 16 has a plurality of backflow prevention openings 84 formed therein of the lower end thereof which communicates with the atmosphere. The backflow prevention openings 84 are closed by the cylindrical body member 62 when the poppet means 60 is in its lower position.

The numeral 86 refers to a shroud which extends around the dispenser 8 and which includes a backing plate 88 which may be secured to a wall or the like.

Assuming that only a single dispenser is being used, the operation of the same is as follows. The inlet end of the first water passageway 18 is connected to a source of water under pressure. The discharge end of the water passageway 18 is closed. The water pressure in water passageway 18 is greater than the spring force of the spring 54 so that water pressure against the valve 56 will unseat valve 56 from valve seat 22. At that time, with the first valve stem 42 in its outer position, water from the water passageway 18 cannot pass through the valve seat 34 since valve 48 is in seating engagement therewith.

Figure 10:
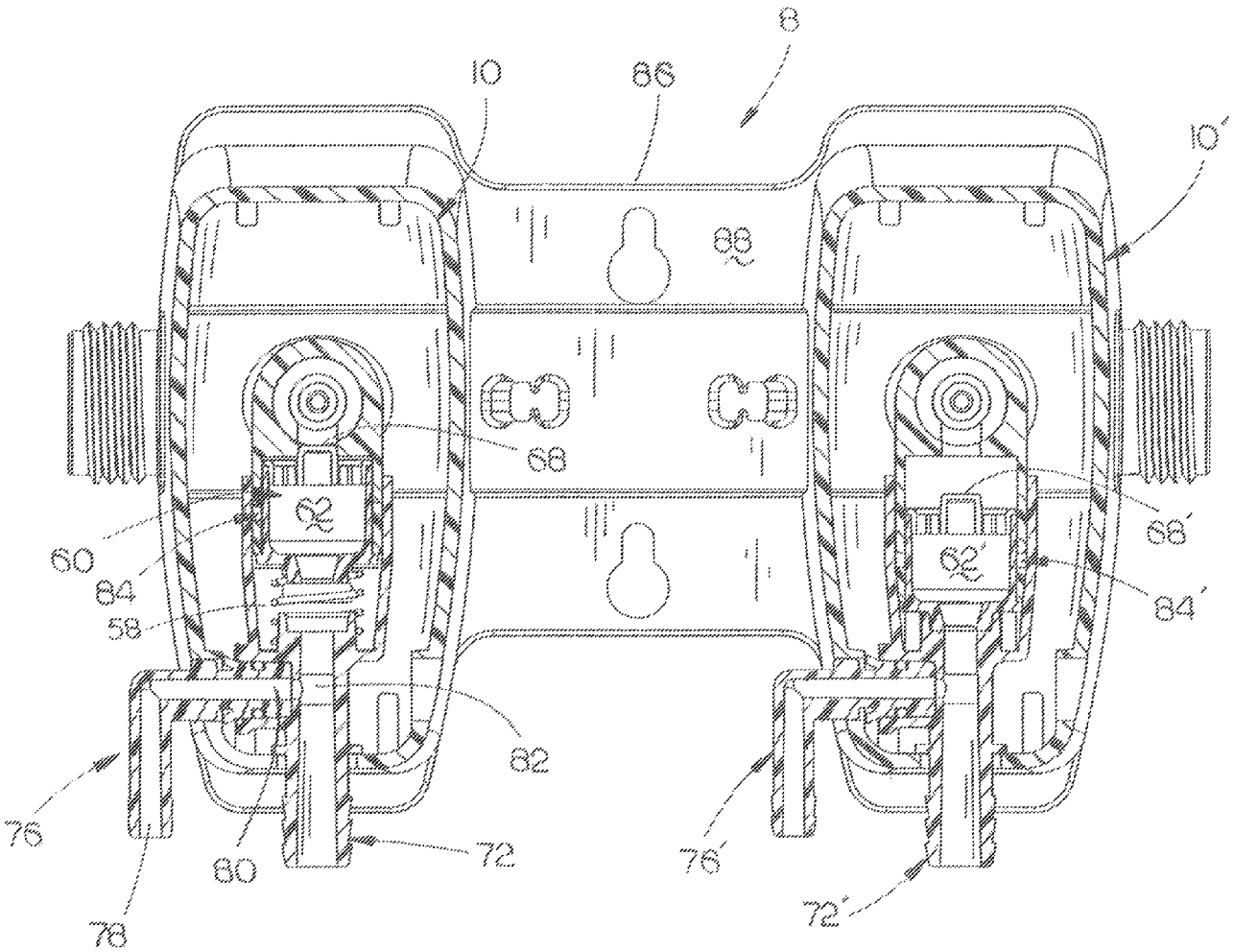
FIG. 10 is a sectional view of the wall mounted dispenser of this invention.

When it is desired to dispense a mixture of water and liquid chemicals, the actuator or operating lever 44 is pushed inwardly which causes the valve stem 42 to move from the position of FIG. 9 inwardly through the bore 30 of the valve guide 28 which unseats the valve 48 from the valve seat 34 thereby permitting water to pass through the second passageway 20, the bore 24, downwardly through the first bore 30 and into the water passageway 26 in body portion 14. The water pressure in bore 30 will be greater than the spring strength of spring 70 so that the water pressure will move the poppet means 60 from an upper position as illustrated in FIG. 9, wherein the closed upper end 68 of the stem 64 was closing water passageway 26, to a lower position such as illustrated in the right side of FIG. 10 so that water may pass downwardly through the hollow stem 44, through the body member 62 and outwardly from the lower open end of the poppet means 60 and thence downwardly into the discharge tube 72. As the water passes the venturi 82, liquid chemical will be drawn upwardly from the liquid chemical container to which the liquid chemical conduit 76 is attached so that chemical will be drawn into the water passing downwardly through the discharge conduit 72 and into a suitable vessel such as a pail, bucket, bottle, etc.

When the selected amount of water and liquid chemical has been dispensed from the dispenser, the inward pressure on the lever 44 will be released which will cause the valve stem 42 to move from its inner position to its outer position so that the valve 48 again closes the valve seat 34 to prevent further water from being passed through the dispenser.

Should a backflow problem arise, which could suck chemical inwardly through the dispenser into the supply of water in the passageway 18 and thence into the source of water, the dispenser has several backflow preventers. First, if suction occurs in water passageway 18, the spring 54 will cause the valve 56 to move into seating engagement with the valve seat 22. Second, if backflow suction should occur in bore 30, poppet means 60 will move upwardly to its upper position so that the closed upper end 68 of the stem 64 will close the water passageway 26. Third, valve 48 will close valve seat 34. Fourth, the chemical within chamber 50 is drained outwardly from the backflow preventers 84.

Thus it can be seen that a novel dispenser has been provided which has a plurality of backflow preventers provided therein. It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A wall mounted dispenser for dispensing a mixture of water and liquid chemical therefrom, comprising:

a first horizontally disposed body portion having a first end, a second end, a forward side and a rearward side;

a second horizontally disposed body portion having a rearward end and a forward end;

said second body portion extending transversely forwardly from said first body portion;

a third vertically disposed body portion, having an upper end and a lower end, extending downwardly from the second body portion;

a first elongated water passageway, having inlet and discharge ends, extending through said first body portion between said first and second ends thereof;

said inlet end of said first water passageway being in fluid communication with a source of water under pressure;

said discharge end of said first water passageway being selectively closable;

said first body portion having a second water passageway formed therein which extends horizontally forwardly from said first water passageway between said inlet and discharge ends thereof;

said second water passageway having rearward and forward ends;

said first body portion having a forwardly presented first annular valve seat formed therein at said forward end of said second water passageway;

said second body portion having a bore, having rearward and forward ends, formed therein which extends forwardly from said first valve seat;

said second body portion having a water passageway which extends downwardly from said bore thereof;

said bore of said second body portion having a greater diameter than said first valve seat;

a cylindrical valve guide, having forward and rearward ends, positioned in said bore of said second body portion forwardly of said first valve seat with said rearward end of said valve guide being spaced from said first valve seat;

said valve guide having a first bore, having forward and rearward ends, extending rearwardly into said valve guide from said forward end thereof;

said valve guide having a second bore, having forward and rearward ends, formed therein which extends rearwardly from said rearward end of said first bore thereof;

said second bore of said valve guide having a greater diameter than said first bore of said valve guide;

said rearward end of said valve guide having a second annular, rearwardly presented valve seat formed therein;

said valve guide having a water passageway, having upper and lower ends, which extends downwardly from said second bore of said valve guide which fluidly communicates with said water passageway which extends downwardly from said second body portion;

a cap, having a central opening formed therein, mounted on said forward end of said valve guide;

an elongated, horizontally disposed first valve stem having forward and rearward ends;

said first valve stem extending rearwardly through said central opening of said cap and into said first bore of said valve guide so that said forward end of said first valve stem is positioned forwardly of said cap and so that said rearward end of said first valve stem is positioned in said rearward end of said bore of said second body portion;

said first valve stem being selectively movable between a first outer position to a second inner position;

an actuator lever movably secured to the dispenser for moving said first valve stem between said outer and inner positions;

said first valve stem having an annular valve mounted thereon which seats upon said second valve seat to close said second valve seat when said first valve stem is in said first outer position;

said first valve stem having an elongated bore formed therein which extends forwardly thereinto from said rearward end thereof;

an elongated second valve stem having forward and rearward ends;

said forward end of said second valve stem being slidably mounted, between extended and retracted positions, in said elongated bore in said first valve stem;

a first spring positioned in said elongated bore in said first valve stem forwardly of said forward end of said second valve stem which yieldably urges said second valve stem towards its said extended position;

said rearward end of said second valve stem having a valve thereon which seats upon said first valve seat to close said first valve seat when said first valve stem is in said first outer position and said second valve stem is in said extended position;

said third body portion having a first chamber formed therein which has upper and lower ends;

said upper end of said chamber being in fluid communication with said water passageway which extends downwardly from said bore of said second body portion;

a poppet means vertically movably mounted in said chamber between upper and lower positions;

said poppet means including a hollow cylindrical body member having open upper and lower ends;

a hollow stem extending upwardly from said open upper end of said hollow cylindrical body member;

said hollow stem having an open side wall and a closed upper end;

a spring in said chamber below said cylindrical body member which yieldably urges said poppet means to said upper position;

said closed upper end of said hollow stem of said poppet means closing said water passageway which extends downwardly from said bore of said second body portion when said poppet means is in said upper position;

a discharge conduit having open upper and lower ends;

said open upper end of said discharge conduit being in fluid communication with said chamber in said third body portion;

said open lower end of said cylindrical body member of said poppet means being in fluid communication with said open upper end of said discharge conduit when said poppet means is in said lower position;

a liquid chemical conduit having intake and discharge ends;

said discharge end of said liquid chemical conduit being in fluid communication with said discharge conduit below said open upper end of discharge conduit;

said inlet end of the liquid chemical conduit is in communication with a source of liquid chemical;

said third body portion having at least one back flow prevention opening formed therein above said lower end thereof which communicates with the atmosphere;

said backflow prevention opening being closed by said cylindrical body member when said poppet means is in said lower position.

2. The wall mounted dispenser of claim 1 wherein a pair of dispensers are mounted together in a side-by-side manner with the discharge end of the first water passageway of the upstream dispenser is in fluid communication with the inlet end of the first water passageway of the downstream dispenser.

3. The wall mounted dispenser of claim 2 wherein the dispensers are molded together.

4. The wall mounted dispenser of claim 1 wherein a plurality of dispensers are mounted in a side-by-side series manner.

5. The wall mounted dispenser of claim 1 wherein the water pressure in said first water passageway is greater than the strength of said spring in said bore in said first valve stem so that said valve on said second valve stem will normally be unseated from said first valve seat but will seat upon said first valve seat when a backflow issue arises.

6. The wall mounted dispenser of claim 1 wherein said poppet means is movable to its said upper position when a backflow issue arises.

* * * * *